US006374520B1

(12) United States Patent
Westendorf et al.

(10) Patent No.: US 6,374,520 B1
(45) Date of Patent: Apr. 23, 2002

(54) BUCKET FOR FRONT END LOADER AND METHOD FOR TRANSPORTING

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 0 days.

(21) Appl. No.: 09/638,579

(22) Filed: Aug. 15, 2000

(51) Int. Cl.[7] ..... E02F 3/40
(52) U.S. Cl. ..... 37/444
(58) Field of Search ..... 37/403, 404, 468, 37/407, 444; 414/703, 723, 680, 697, 700, 920, 685

(56) References Cited

U.S. PATENT DOCUMENTS

| | | | |
|---|---|---|---|
| 2,326,338 | A | 8/1943 | Drott et al. |
| 2,812,595 | A | 11/1957 | Drott et al. |
| 3,077,999 | A | 2/1963 | Svoboda |
| 3,209,474 | A | 10/1965 | Artman |
| 3,243,905 | A | 4/1966 | Ulrich |
| 3,344,540 | A | 10/1967 | Ulrich |
| 3,455,477 | A | 7/1969 | Blair |
| 3,512,665 | A | 5/1970 | Westendorf |
| 3,701,443 | A | 10/1972 | Lely |
| 4,051,962 | A | 10/1977 | Westendorf |
| 4,085,856 | A | 4/1978 | Westendorf |
| 4,565,485 | A | 1/1986 | Wilman |
| 4,566,844 | A | 1/1986 | Campin |
| 4,606,692 | A | 8/1986 | Langenfeld et al. |
| 4,787,811 | A | 11/1988 | Langenfeld et al. |
| 4,790,084 | A | 12/1988 | Anderson et al. |
| 4,797,051 | A | 1/1989 | Langenfeld et al. |
| 4,859,130 | A | 8/1989 | Langenfeld et al. |
| 4,890,400 | A | 1/1990 | Long |
| 4,915,575 | A | 4/1990 | Langenfeld et al. |
| 4,930,974 | A | 6/1990 | Langenfeld et al. |
| 4,968,213 | A | 11/1990 | Langenfeld et al. |
| 4,995,760 | A | 2/1991 | Probst et al. |
| 5,121,557 | A | 6/1992 | Moore |
| 5,466,113 | A | 11/1995 | Norberg |
| 5,785,328 | A | 7/1998 | Eckloff |
| 5,997,237 | A | 12/1999 | Langenfeld et al. |

*Primary Examiner*—Robert E. Pezzuto
(74) *Attorney, Agent, or Firm*—Merchant & Gould P.C.

(57) ABSTRACT

A bucket for a front end loader. The bucket includes a floor, a back wall, a left sidewall, and a right sidewall. The floor includes a floor leading edge, a floor trailing edge, a floor left edge, and a floor right edge. The back wall includes a back wall leading edge, a back wall trailing edge, a back wall left edge and a back wall right edge. The left sidewall extends along the left edges of the floor and the back wall, and the right sidewall extends along the right edges of the floor and the back wall. The bucket can be characterized as having a tapered construction. This means that the length of the floor leading edge and the length of the back wall leading edge are greater than the length of the floor trailing edge and the length of the back wall trailing edge, respectively. The difference in lengths provides buckets that can be stacked for transportation. A method for transporting a plurality of buckets is provided.

11 Claims, 5 Drawing Sheets

BUCKET FOR FRONT END LOADER AND METHOD FOR TRANSPORTING

FIELD OF THE INVENTION

The invention relates to a bucket for a front end loader and to a method for transporting buckets for front end loaders. More particularly, the bucket includes a tapered configuration that allows multiple buckets having the same configuration to be stacked for transportation and provides benefits for handling certain types of loads.

BACKGROUND OF THE INVENTION

Buckets for material handling equipment are fairly conventional. Exemplary prior art buckets are described by U.S. Pat. No. 2,326,338 to Drott et al., U.S. Pat. No. 2,812,595 to Drott et al., U.S. Pat. No. 3,077,999 to Svoboda, U.S. Pat. No. 3,209,474 to Artman, U.S. Pat. No. 3,243,905 to Ulrich, and U.S. Pat. No. 4,790,085 to Andersen et al.

SUMMARY OF THE INVENTION

A bucket for a front end loader is provided. The bucket includes a floor, a back wall, a left sidewall, and a right sidewall. The floor includes a floor leading edge, a floor trailing edge, a floor left edge, and a floor right edge. The back wall includes a back wall leading edge, a back wall trailing edge, a back wall left edge and a back wall right edge. The left sidewall extends along the left edges of the floor and the back wall, and the right sidewall extends along the right edges of the floor and the back wall. Preferably, the bucket includes a bottom wall extending between the floor trailing edge and the back wall trailing edge. The bucket can be characterized as having a tapered construction. This means that the lengths of the floor leading edge and the back wall leading edge are greater than the lengths of the floor trailing edge and the back wall trailing edge, respectively. Preferably, the difference in length is sufficient to allow buckets having the same configuration to be stacked for transportation. The tapered construction is preferably provided so that the lengths of the floor leading edge and the back wall leading edge are greater than the lengths of the floor trailing edge and the back wall trailing edge by at least about 0.5 inch, more preferably at least about 1 inch, and even more preferably at 2 inches. Preferably, the difference in length is based upon a bucket having a depth of 20 inches. Accordingly, the bucket can have a depth that is greater or smaller than 20 inches, and the pitch or slope of the edges can be based upon a depth of 20 inches.

A method for transporting a plurality of buckets for front end loaders is provided according to the invention. The method includes a step of providing a plurality of buckets having a tapered configuration and stacking the plurality of buckets.

DETAILED DESCRIPTION OF THE INVENTION

Figure 1:
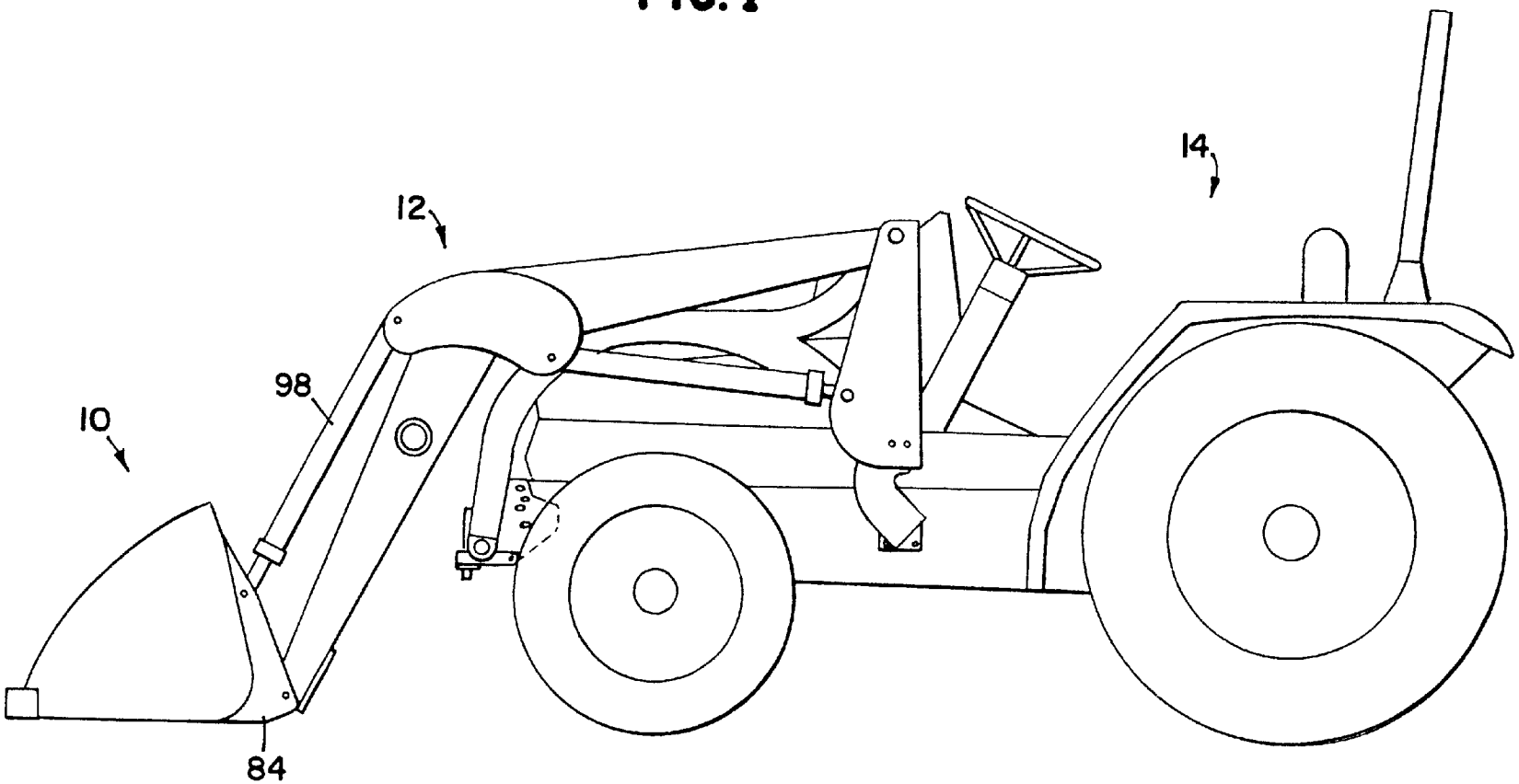
FIG. 1 is a side view of a tractor having a front end loader and a bucket according to the invention attached to the front end loader.

Now referring to FIG. 1, a bucket 10 according to the invention is shown attached to the loader 12 of the tractor 14. The bucket 10 is provided as a scoop for picking up and moving dry or wet materials such as manure, corncobs, feed, dirt, sand, gravel, snow, and fertilizer. The loader 12 can be referred to as a front end loader. The operation of the specific front end loader shown in FIG. 1 is described in copending U.S. patent application Ser. No. 09/639,039 filed on Aug. 15, 2000 the entire disclosure of which is incorporated herein by reference.

Now referring to FIGS. 2–5, the bucket 10 includes a floor 16, a back wall 18, a left sidewall 20, and a right sidewall 22. It should be understood that the reference to "left" and "right" is based upon the perspective of one looking at the bucket 10 from the opening 24 as provided in FIG. 5.

The floor 16 includes a leading edge 26, and trailing edge 28, a left side edge 30, and a right side edge 32. The back wall 18 includes a leading edge 34, trailing edge 36, a left side edge 38, and a right side edge 40. The left sidewall 20 includes a leading edge 42, a trailing edge 44, a bottom edge 46, and top edge 48. The right sidewall 22 includes a leading edge 50, a trailing edge 52, a lower edge 54, and a top edge 56. The bucket 10 additionally includes a bottom wall 60 having a bottom edge 62, a top edge 64, a left edge 66, and a right edge 68. While a preferred embodiment of the bucket according to the invention includes the bottom wall 60, it should be appreciated that the bucket can be provided without the bottom wall 60. That is, the floor 16 and the back wall 18 can be extended so that they merge at a single location. Alternatively, the floor 16 on the back wall 18 can be configured so that they form a single, curved wall having no definitive edge. If, for example, the floor and the back wall are formed from a single, curved wall, it should be appreciated that the floor trailing edge and the back wall trailing edge are considered to be the bottom-most portion of the bucket.

Figure 2:
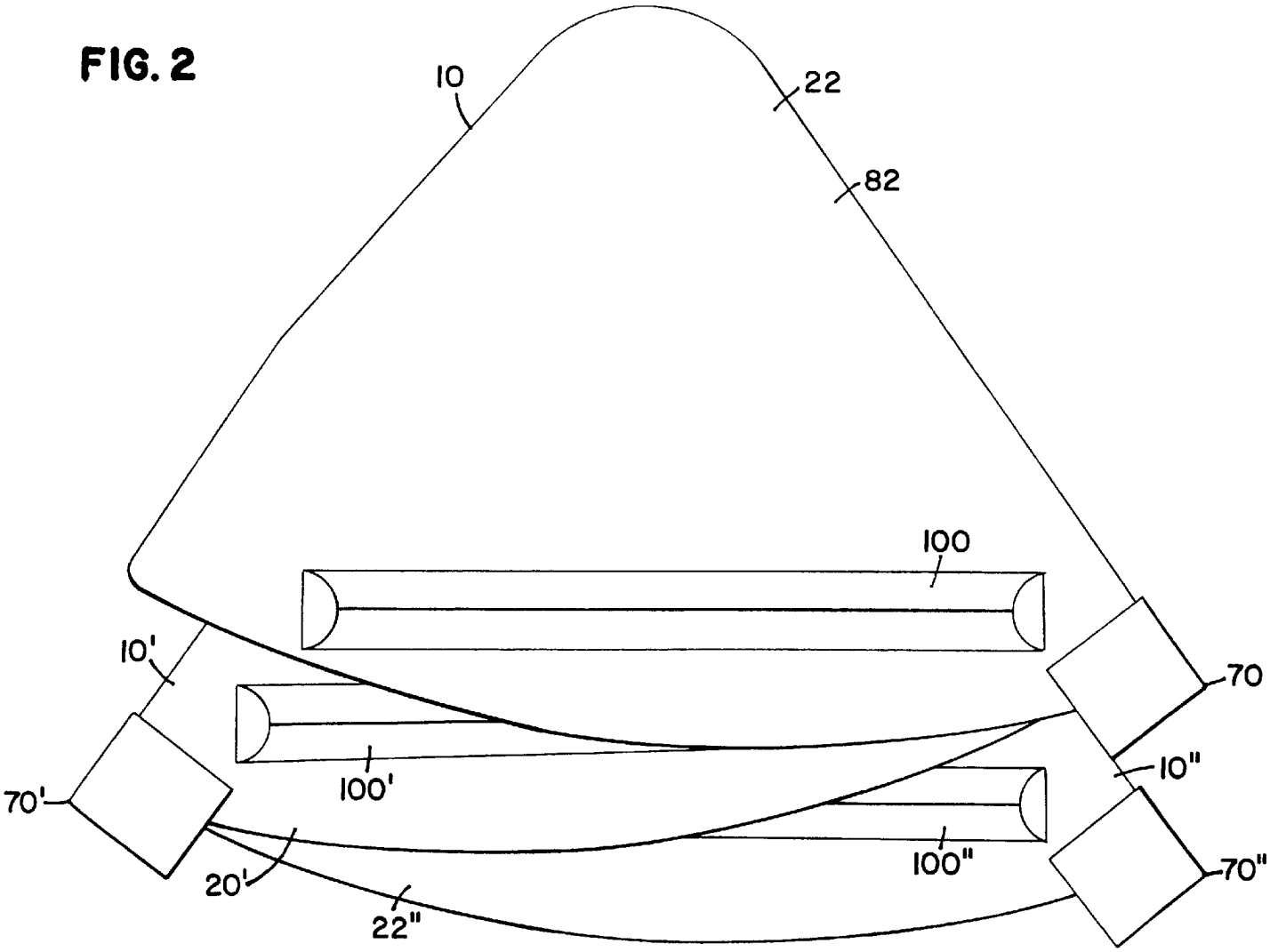
FIG. 2 is a side view of three stacked buckets according to the invention.
Figure 3:
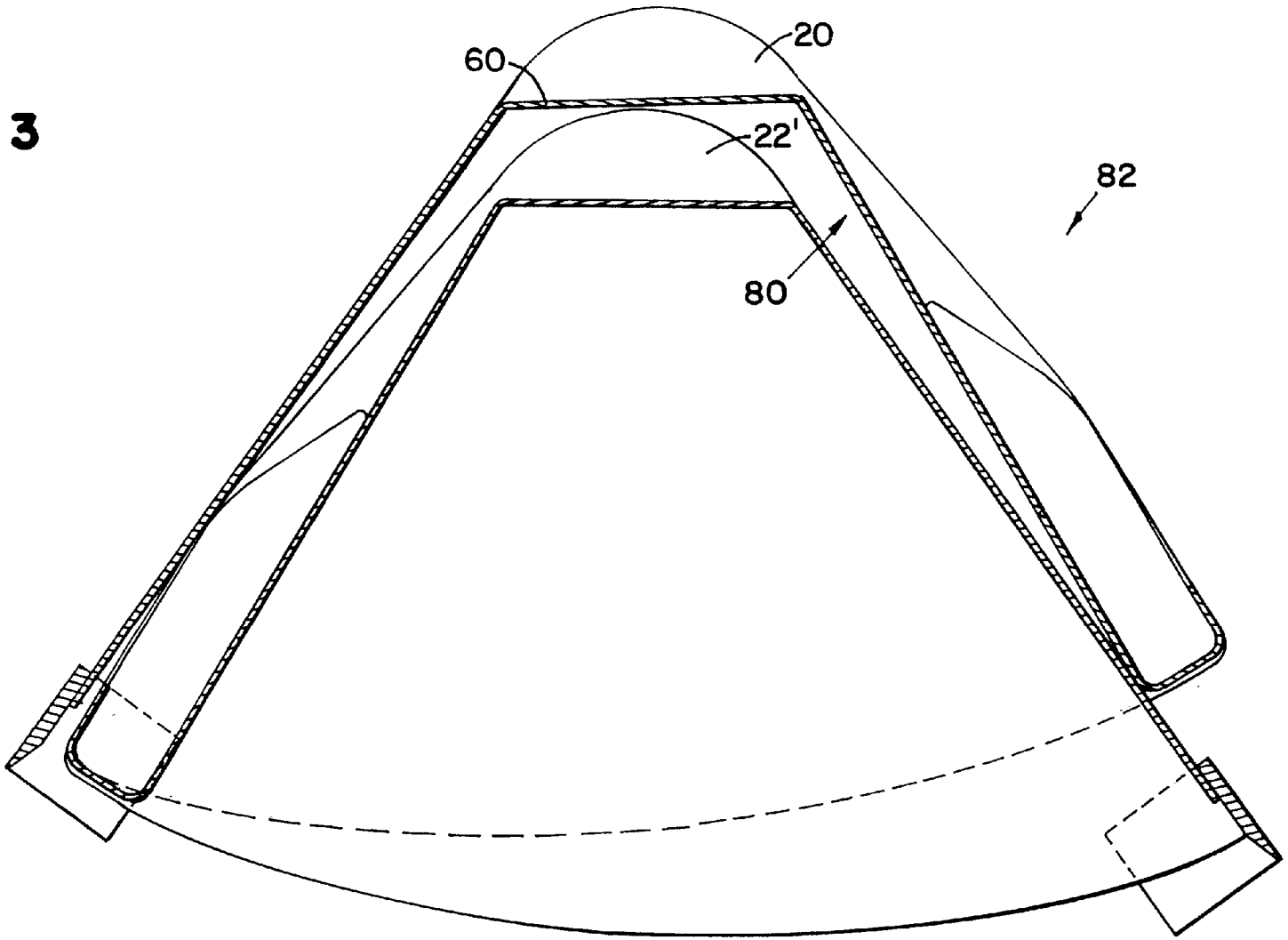
FIG. 3 is a sectional view of two stacked buckets according to the invention.

The bucket 10 can be characterized as having a tapered construction. By a tapered construction, it is meant that the length of the floor trailing edge 28 is shorter than the length of the floor leading edge 26, and the length of the back wall trailing edge 36 is shorter than the length of the back wall leading edge 34. The difference in lengths is sufficient to provide stacking of multiple buckets as shown in FIGS. 2 and 3. Preferably, the lengths of the floor leading edge 26 and the back wall leading edge 34 are greater than the lengths of the floor trailing edge 28 and the back wall trailing edge 36 by at least about 0.5 inch. Preferably the difference in lengths is at least about 1.0 inch, and more preferably at least about 2 inches. In a particularly preferred bucket, the depth of the bucket is 20 inches, the lengths of the floor and back wall leading edges are about 72 inches, and the lengths of the floor and back wall trailing edges are about 68 inches. In a preferred smaller bucket having a depth of about 20 inches, the lengths of the floor and back wall leading edges are about 64 inches, and the lengths of the floor and back wall trailing edges are about 60 inches. Preferably, the difference in lengths is no greater than about 10 inches per 20 inches of depth. It should be appreciated that the difference in lengths can be used to reflect a pitch or average slope of the left and right edges of the floor and back wall. That is, the depth of the bucket can be less than or greater than 20 inches, and the slope of the left and right edges of the floor and back wall are preferably based upon a depth of 20 inches. It should be understood that the left and right edges of the floor and back wall can be linear or non-linear. An exemplary nonlinear configuration includes a bowed configuration.

As shown in FIG. 3, the sidewall 20 is provided extending beyond the bottom wall 60. If desired, the back wall can be provided so that it follows the curve of the sidewall 20.

A scrapper blade 70 is provided extending along the length of the leading edge 26 of the floor 16. The scrapper blade 70 includes a left scrapper end 72 extending along a portion of the left sidewall 20, and a right scrapper blade end 74 extending along a portion of the right sidewall 22. The scrapper blade 70 is preferably welded to the floor 16, the left sidewall 20, and the right side wall 22. The scraper blade 70 is provided for enhancing the durability of the leading edge 26 of the floor 16. The use of a scraper blade can be omitted if it is desired not to have a scraper blade on the bucket.

Figure 4:
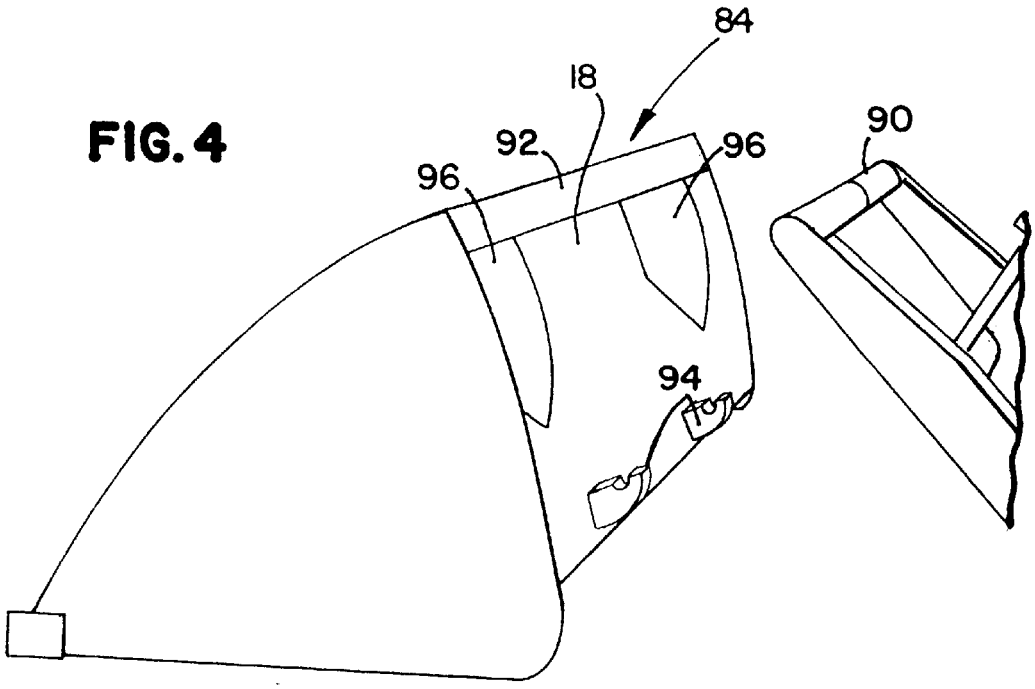
FIG. 4 is a perspective view of the backside of the bucket of FIG. 1.
Figure 5:
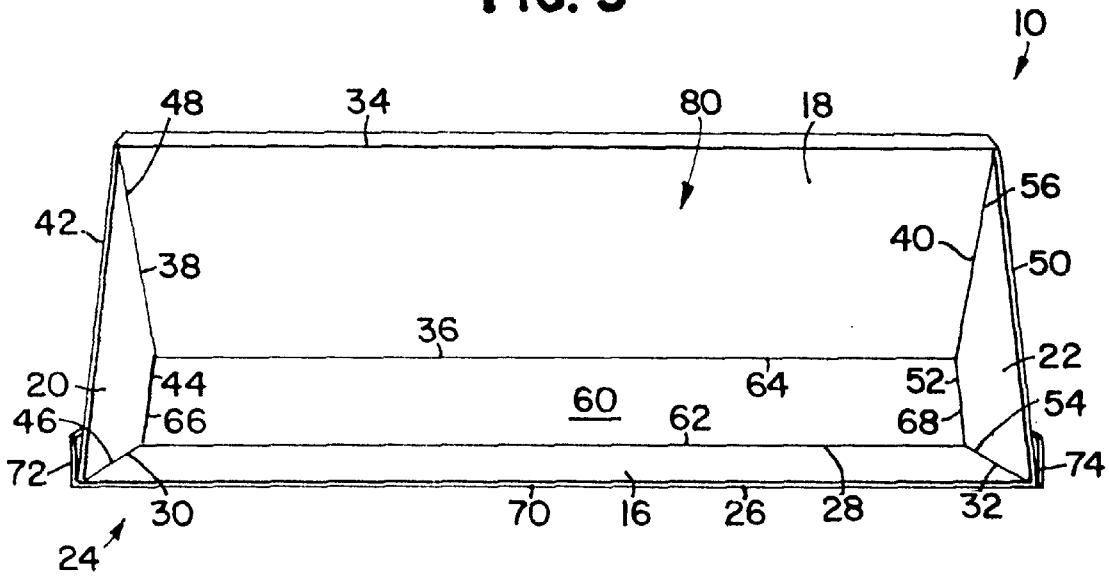
FIG. 5 is a front plan view of the bucket of FIG. 1.

The bucket 10 includes an interior surface 80 and an exterior surface 82. The exterior surface of the back wall 18 includes a coupler 84 for attachment to the front end loader 12. The coupler 84 is a preferably provided as a quick attachment device such as the quick attachment device described by U.S. Pat. No. 4,787,811 to Langenfeld et al., the entire disclosure of which is incorporated herein by reference. Additional couplers which can be used according to the invention are described in U.S. Pat. No. 4,797,015 to Langenfeld et al., U.S. Pat. No. 4,859,130 to Langenfeld et al., 4,915,575 to Langenfeld et al., and U.S. Pat. No. 4,968,213 to Langenfeld et al. The patents are incorporated herein by reference. As shown in FIG. 4, an arm or pipe 90 is provided on the front end loader 12 for engaging the lip 92 provided along a portion of the exterior surface 82 of the back wall 18. The exterior surface 82 of the back wall 18 additionally includes hooks 94 for engaging the front end loader. Flanges 96 are provided on the back wall 18 to contain the arm 90 within in the lip 92. In general, the quick attachment device is pivoted by hydraulic cylinder 98 which is a part of the loader 12.

Now referring to FIG. 2, three stacked buckets 10, 10', and 10" are shown. As shown, the sidewalls include beveled regions 100, 100', and 100" for providing additional reinforcement.

When stacking the buckets according to the invention, it is preferred to provide the buckets stacked alternatively. As shown in FIG. 2, the buckets are alternated when stacking. That is, buckets 10 and 10" include a blade 70 and 70" facing in one direction and the bucket 10' includes a blade 70' facing in the opposite direction. It should be appreciated that by alternating the stacking of the buckets, an economy of space can be provided.

It should be appreciated that the bucket of the present invention is particularly useful for farm applications. It is expected that the bucket can be used, for example, in feed yards where food additives including vines, loose hay or silage, and corn stalks are mixed with a bale of hay. The bucket is capable of loading the loose materials into a mixer wagon. In addition, the tapered construction of the bucket according to the invention allows for certain types of materials to flow out of the bucket at once in a "plug" type configuration. It is believed that the tapered configuration provides a better and more even flow of material out of the bucket compared to prior art buckets. That is, the tapered configuration allows the bucket to empty quickly and cleanly.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A bucket for a front end loader comprising:

(a) a floor having a floor leading edge, a floor trailing edge, floor left edge, and a floor right edge, wherein:
  (i) the length of the floor leading edge is greater than the length of the floor trailing edge; and
  (ii) the floor comprises a scrapper blade provided along the length of the floor leading edge;

(b) a back wall comprising a back wall leading edge, a back wall trailing edge, a back wall left edge, and a back wall right edge, wherein:
  (i) the length of the back wall leading edge is greater than the length of the back wall trailing edge;

(c) a left sidewall extending along the left edges of the floor and the back wall; and (d) a right sidewall extending along the right edges of the floor and the back wall.

2. A bucket according to claim 1, further comprising a bottom wall provided connecting the floor to the back wall.

3. A bucket according to claim 1, wherein the back wall farther comprises an exterior surface having a coupler for attaching the bucket to a loader.

4. A bucket according to claim 1, wherein the lengths of the floor leading edge and the back wall leading edge are greater than the lengths of the floor trailing edge and the back wall trailing edge by at least about 0.5 inch.

5. A bucket according to claim 1, wherein the lengths of the floor leading edge and the back wall leading edge are greater than the lengths of the floor trailing edge and the back wall trailing edge by at least about 2 inches.

6. A bucket according to claim 1, wherein the length of the floor leading edge, the length of the floor trailing edge, the length of the back wall leading edge, and the length of the back wall trailing edge are provided so that the bucket has a tapered construction allowing for stacking of multiple buckets having the same configuration.

7. A method for transporting a plurality of buckets for front end loaders, the method comprising a step of:

providing a plurality of buckets having a tapered configuration and stacking the buckets having the same configuration, each bucket comprising:

(a) a floor having a floor leading edge, a floor trailing edge, floor left edge, and a floor right edge, wherein:
  (i) the length of the floor leading edge is greater than the length of the floor trailing edge; and
  (ii) the floor comprises a scrapper blade provided along the length of the floor leading edge;

(b) a back wall comprising a back wall leading edge, a back wall trailing edge, a back wall left edge, and a back wall right edge, wherein:
  (i) the length of the back wall leading edge is greater than the length of the back wall trailing edge;

(c) a left sidewall extending along the left edges of the floor and the back wall; and (d) a right sidewall extending along the right edges of the floor and the back wall.

8. A method according to claim 7, wherein the plurality of buckets comprise a bottom wall provided connecting the floor wall to the back wall.

9. A method according to claim 7, wherein the back wall further comprises an exterior surface having a coupler for attaching the bucket to a loader.

10. A method according to claim 7, wherein the lengths of the floor leading edge and the back wall leading edge are greater than the lengths of the floor trailing edge and the back wall trailing edge by at least about 0.5 inch.

11. A method according to claim 7, wherein the lengths of the floor leading edge and the back wall leading edge are greater than the lengths of the floor trailing edge and the back wall trailing edge by at least about 2 inches.

* * * * *